US005491995A

United States Patent [19]

Stodd

[11] Patent Number: 5,491,995

[45] Date of Patent: Feb. 20, 1996

[54] APPARATUS FOR HIGH SPEED PRODUCTION OF SHELLS FOR BEVERAGE CONTAINERS

[76] Inventor: Ralph P. Stodd, 6450 Poe Ave., Suite 213, Dayton, Ohio 45414

[21] Appl. No.: 398,910

[22] Filed: Mar. 6, 1995

Related U.S. Application Data

[63] Continuation of Ser. No. 139,032, Oct. 21, 1993, abandoned.

[51] Int. Cl.[6] ..... B21D 51/44

[52] U.S. Cl. ..... 72/68; 72/92

[58] Field of Search ..... 72/68, 92, 93, 72/94, 348, 361

[56] References Cited

U.S. PATENT DOCUMENTS

| | | | |
|---|---|---|---|
| 1,622,540 | 3/1927 | Peters | 72/93 |
| 4,382,737 | 5/1983 | Jensen et al. | 72/348 |
| 4,895,012 | 1/1990 | Cook et al. | 72/361 |
| 5,042,284 | 8/1991 | Stodd et al. . | |

FOREIGN PATENT DOCUMENTS

| | | | |
|---|---|---|---|
| 687062 | 5/1964 | Canada | 72/94 |

*Primary Examiner*—Lowell A. Larson
*Attorney, Agent, or Firm*—Jacox, Meckstroth & Jenkins

[57] ABSTRACT

A reciprocating mechanical press has two laterally spaced rows of tooling components or modules for producing corresponding rows of sheet metal container shells with each stroke of the press. The shells are ejected laterally outwardly from both s ides of the press into corresponding guide chutes by air jet nozzles which project at slightly different elevations from opposite sides of an air supply manifold extending between the rows of tooling modules. A plurality of curling units are connected to the guide chutes extending from both sides of the press, and each curling unit includes a driven curling wheel having a rim portion supporting multiple level inner die rings separated by corresponding shell support rings. A plurality of circumferentially arranged arcuate die sections radially oppose each inner die ring and are supported in stacked relation by a base member which also supports the rotatable shaft for the curling wheel.

13 Claims, 3 Drawing Sheets

APPARATUS FOR HIGH SPEED PRODUCTION OF SHELLS FOR BEVERAGE CONTAINERS

This is a continuation of application Ser. No. 08/139,032, filed Oct. 21, 1993, now abandoned.

BACKGROUND OF THE INVENTION

In a mechanical press equipped with tooling modules or stations for producing aluminum top end walls or shells for aluminum beverage cans, for example, as disclosed in U.S. Pat. No. 5,042,284 which issued to the assignee of the present invention, a batch of aluminum shells are produced with each stroke of the press. The shells are discharged from one side of the press through tubular guide chutes and by air jets, for example, as disclosed in FIG. 11 of the above patent. The guide chutes sometimes extend to endless belt conveyors which convey the shells to curling machines for rolling the peripheral lip portions of the shells inwardly to facilitate attachment of the shell to the rim portion of an aluminum can. The conventional curling machine includes a rotary curling wheel and a peripherally extending curling die for each of the belt conveyors, and each belt conveyor usually receives the shells discharged through guide chutes extending from two or more tooling stations within the press.

It has been found desirable to increase the number of tooling stations within a single or double action mechanical press and for the press to receive a wider strip of aluminum stock so that a larger batch of shells may be produced with each stroke of the press. For example, if shells are produced in a press operating over 400 strokes per minute and having 22 tooling stations and equipped for receiving an aluminum strip having a 52 inch width, the shells are produced more efficiently and at a substantially higher volume per minute. However, when producing shells at such a high rate, there is a problem of controlling the flow of shells from the tooling stations onto the endless belt conveyors so that the shells do not overlap and are fed to the curling machines in single file. Furthermore, a large number of rotary curling machines is required to handle the high flow rate of shells, and the machines require substantial floor space in addition to the investment in the curling machines.

In order to reduce the number of curling machines required for handling a larger flow rate of shells, a pair of rotary curling wheels have been mounted on a common drive shaft in axially spaced relation with each wheel positioned to receive the shells being delivered by one conveyor belt. Such a curling machine has been produced by E. W. Bliss Co. in Hastings, Mich.

SUMMARY OF THE INVENTION

The present invention is directed to improved apparatus which is ideally suited for efficiently producing a high volume of metal shells for metal beverage containers and with the lip portions of the shells curled inwardly ready for attachment to the upper end portion of a formed metal cup or can. The apparatus of the invention is especially suited for producing over twenty shells with each stroke of a high speed press and for subsequently curling the lip portions of the shells. The apparatus also provides for maintaining a uniform and high speed flow of the shells in single file from the press and through the curling machines in order to avoid jamming and down time of the apparatus.

In accordance with a preferred embodiment of the invention, the above features and advantages are generally provided by a high speed mechanical press equipped with modular tooling components which forms two laterally spaced rows of tooling stations. The formed shells are ejected laterally outwardly from both sides of the press and in opposite directions through corresponding guide chutes and by corresponding air jet directing nozzles. The nozzles can be positioned at slightly different elevations from opposite sides of an air supply manifold which extends between the rows of tooling stations.

The shells are directed by the guide chutes extending from the tooling stations to a set of curling units each of which includes a driven wheel supporting a plurality of multiple level inner die rings separated by corresponding shell support rings. A set of circumferentially arranged arcuate outer die sections radially oppose each of the inner die rings and are supported in stack relation by an arcuate portion of a base member which also supports the rotatable shaft for the curling wheel. Each shell is directed by its own chute to its own curling level or curling area which eliminates blending of shells and thereby allows higher speed operation. The apparatus minimizes the maintenance required for the apparatus and permits the shells to be produced at a high volume flow rate without jamming the chutes, curling units or downstream equipment.

Other features and advantages of the invention will be apparent from tile following description, the accompanying drawings and the appended claims.

DESCRIPTION OF THE PREFERRED EMBODIMENT

Figure 1:
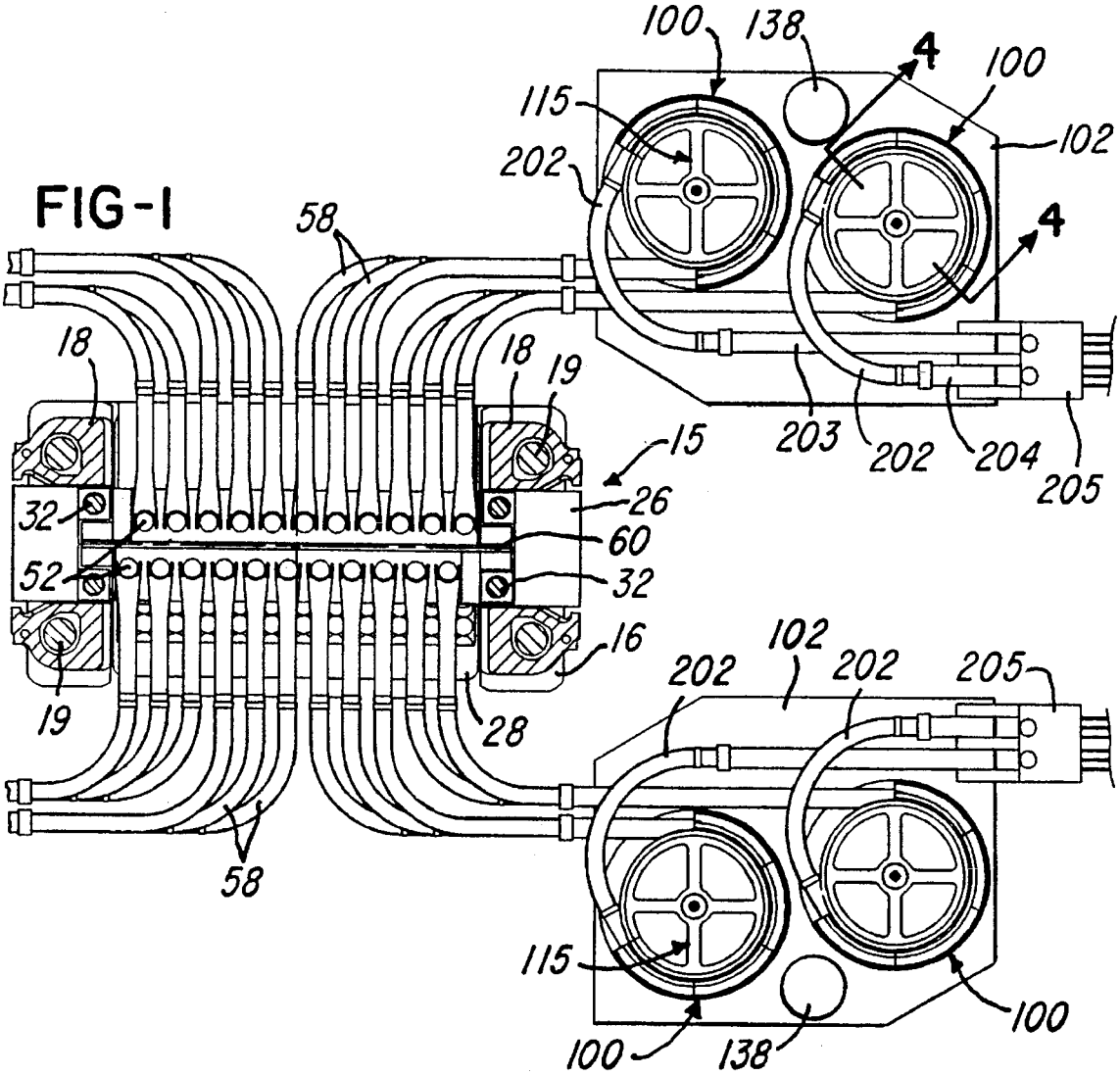
FIG. 1 is a diagrammatic plan view of shell forming modular tooling stations within a mechanical press and showing air guide chutes which direct shells from both sides of the press to a set of curling units in accordance with the invention.

Referring to FIG. 1, a mechanical press 15 includes a base 16 connected by columns 18 and tie rods 19 to an upper press frame (not shown). In a conventional manner, the upper frame supports a movable horizontal platen (not shown) which reciprocates vertically in response to a rotary cam drive. An upper die shoe 24 (FIG. 2) is mounted on the vertically movable upper platen, and a lower die shoe 26 is mounted on a bolster plate 28 forming part of the press base 16. A set of corner guide rods or pins 32 are secured to the lower die shoe 26 and project upwardly for receiving anti-friction tubular bearings mounted within the upper die shoe 24 to provide precision vertical movement for the upper die shoe 24 relative to the lower die shoe with operation of the press.

Figure 2:
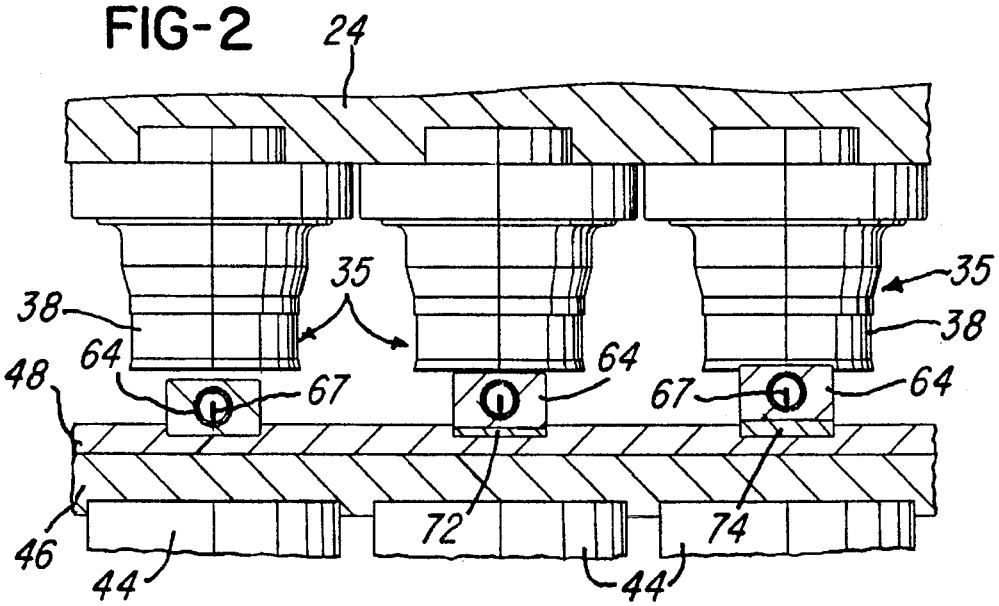
FIG. 2 is an enlarged fragmentary section of three modular tooling stations and showing the air discharge nozzles for the tooling stations.
Figure 3:
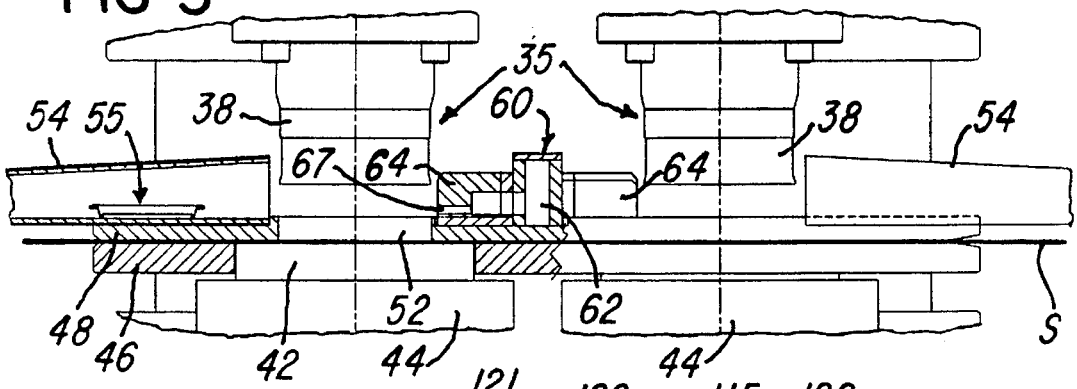
FIG. 3 is a fragmentary section of an air ejector nozzle and shell conveyor chute and with the modular tooling components shown in elevation.

In the press 15 illustrated, the vertical movement or stroke of the upper die shoe 24 is about 1 ¾ inch and the press is adapted to be operated at a relatively high speed, for example, on the order of 400 to 550 strokes per minute. The upper die shoe 24 and lower die shoe 26 support two rows of tooling stations formed by horizontally spaced modular tooling components or tooling modules 35 (FIGS. 2 & 3). Each of the tooling modules is constructed generally as shown in FIG. I of above-mentioned U.S. Pat. No. 5,042,284, the disclosure of which is herein incorporated by reference.

Referring to FIG. 1 of the present application, twenty two tooling modules 35 are arranged in two laterally spaced rows with each module 35 including an upper blank and draw die 38 (FIGS. 2 & 3) carried by the upper die shoe 24 and an annular cut edge die 42 and die retainer 44 supported by the lower die shoe 26. A stock plate 46 (FIGS. 2 & 3) is also mounted on the lower die shoe 26 and supports a web or strip S of aluminum sheet metal which is fed into the press laterally or perpendicular to the rows of tooling modules 35. A stripper plate 48 (FIGS. 2 & 3) holds the strip S downwardly against the stock plate 46 and defines a circular opening or pocket 52 (FIG. 1 & 3) for each of the tooling modules 35.

As shown in FIG. 3, and also in FIG. 11 of above mentioned U.S. Pat. No. 5,042,284, a tubular discharge chute 54 extends laterally outwardly from each of the tooling modules 35 for directing formed aluminum shells 55 from the tooling module immediately after it is produced. In accordance with the present invention and as illustrated in FIG. 1, the conveyor or discharge chutes 54 extend outwardly towards opposite sides of the press 15 and are connected to corresponding tubular extension chutes 58 which curve so that eleven chutes 58 merge together and extend towards each end of the press with five chutes 58 on one side of the press and six chutes on the opposite side of the press. While a "22 out" press is shown for purpose of illustration, it is understood that more or less tooling stations may be incorporated in the press 15 which may be a single action or double action press.

Referring to FIG. 3 and in accordance with the invention, an air ejector manifold 60 extends longitudinally of press on its center line and between the parallel rows of tooling modules 35 on top of the stripper plate 48. Pressurized air is supplied to the manifold 60 through a longitudinally extending chamber 62, and an ejector nozzle 64 projects laterally from the manifold 60 adjacent each of the tooling modules 35 and diametrically opposite the corresponding discharge chute 54 for the module. An air discharge passage 67 directs a stream of air from the manifold 60 laterally below the corresponding blank and draw die 38 for ejecting each shell 55 into the discharge chute 54 in the same manner as disclosed in above-mentioned U.S. Pat. No. 5,042,284 in connection with FIG. 11.

In accordance with the present invention and as shown in FIG. 2, the ejector nozzles 64 For each set of three successive chutes 54 are positioned at slightly different elevations by means of shim plates 72 and 74 so that the nozzle opening 67 for each set of three chutes 54 are at slightly different elevations. Thus while the twenty two shells 55 are simultaneously produced with each stroke of the press 15, the shells are ejected from the corresponding tooling modules 35 in slightly staggered timed relation. That is, the lowermost group of nozzle outlets 67 first eject the corresponding shells 55 as the blank and draw dies 38 are moving upwardly. The nozzle outlet 67 above the shim plate 72 then eject another group of shells 55, and these are followed by the shells ejected by the air streams from the discharge openings 67 above the shim plate 74.

Figure 7:
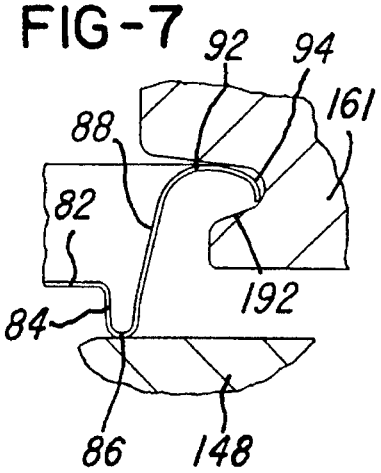
FIG. 7–9 are enlarged fragmentary sections of the curling dies shown in FIG. 5, taken generally on the lines 7—7, 8—8 and 9—9 of FIG. 6, and illustrating the inward curling of the lip portion of a shell.
Figure 8:
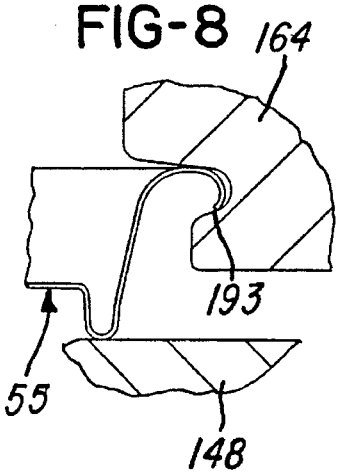
Figure 9:
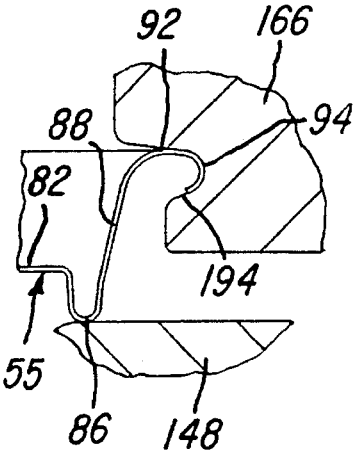

Referring to FIG. 7–9, each of the shells 55 is formed from the sheet aluminum strip S having a thickness of about 0.0088 inch. Each shell 55 includes a flat circular center panel 82 which is connected by a substantially cylindrical panel wall 84 to an annular countersink portion 86 having a U-shaped cross-sectional configuration. A tapered or frustoconical chuckwall 88 connects the countersink portion 86 to a crown portion 92 which has a downwardly projecting peripheral lip portion 94.

The shells 55 are conveyed by the air blasts from the nozzle outlets 67 and flowing within the chutes 54 and extension chutes 58 to a pair of rotary curling units 100 located at each corner of the press 15. The curling units 100 are effective to progressively roll or curl the lip portion 94 of each shell 55 inwardly to an undercut position as shown in FIGS. 7–9.

Each pair of rotary curling units 100 (FIG. 1) located at each corner of the press 15 are supported by an elevated platform 102, and each curling unit 100 is connected to two or three extension chutes 58 for successively receiving the shells 55 produced by the corresponding tooling modules 35 within the press 15.

Figure 4:
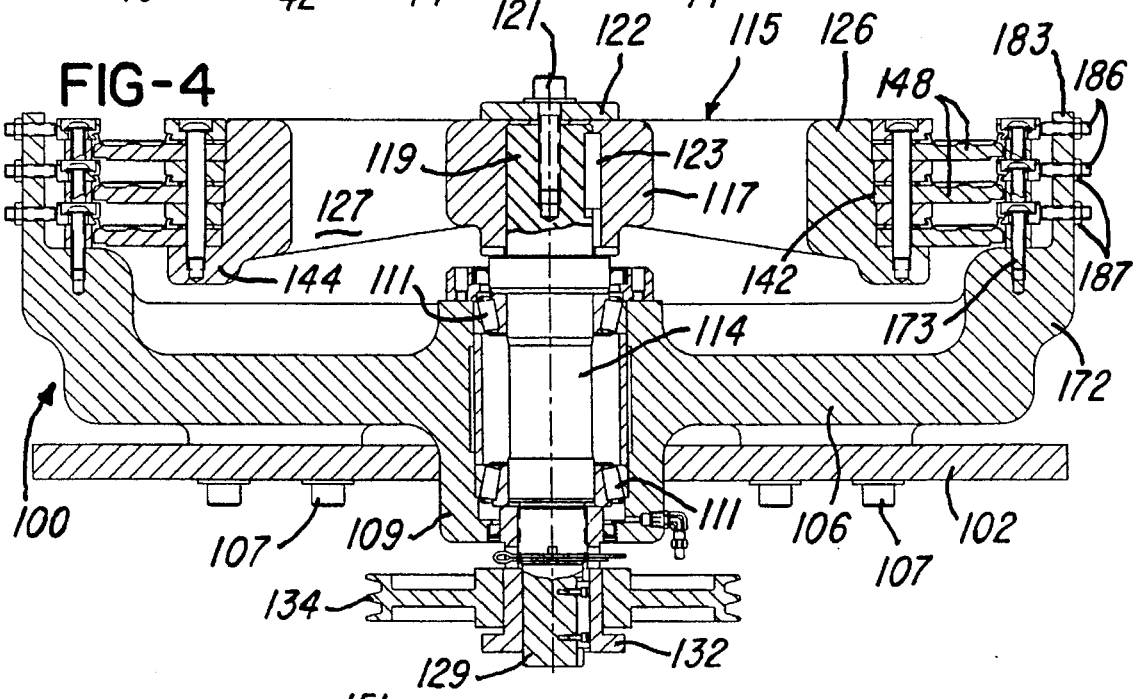
FIG. 4 is an enlarged vertical or axial section of a curling unit constructed in accordance with the invention and taken generally on the line 4—4 of FIG. 1.
Figure 5:
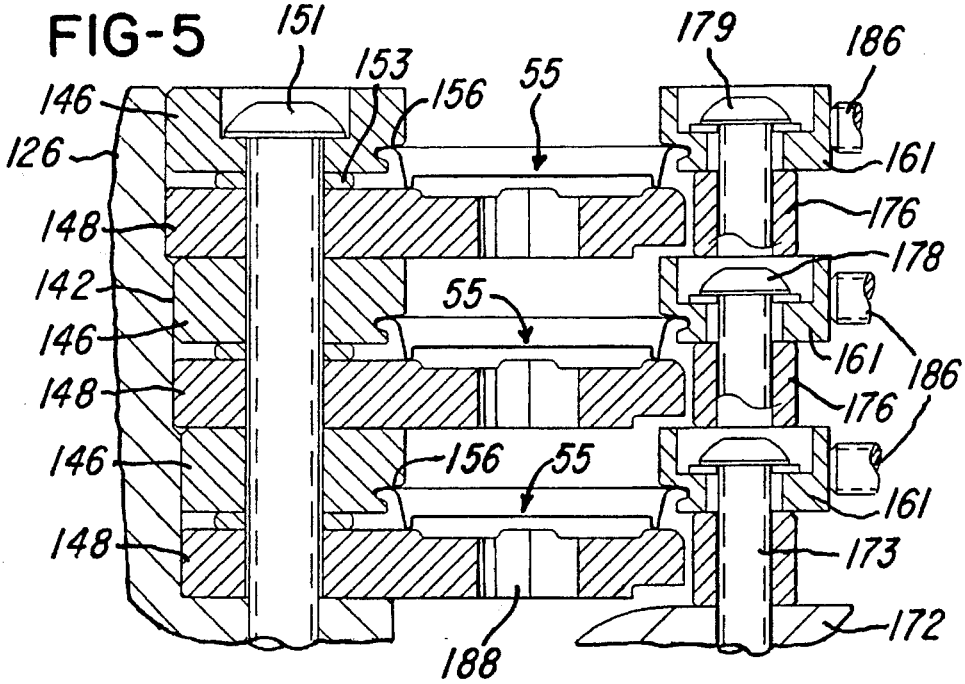
FIG. 5 is an enlarged fragmentary section of the curling unit shown in FIG. 4 and illustrating the multiple level die rings for curling peripheral lip portions of the shells.
Figure 6:
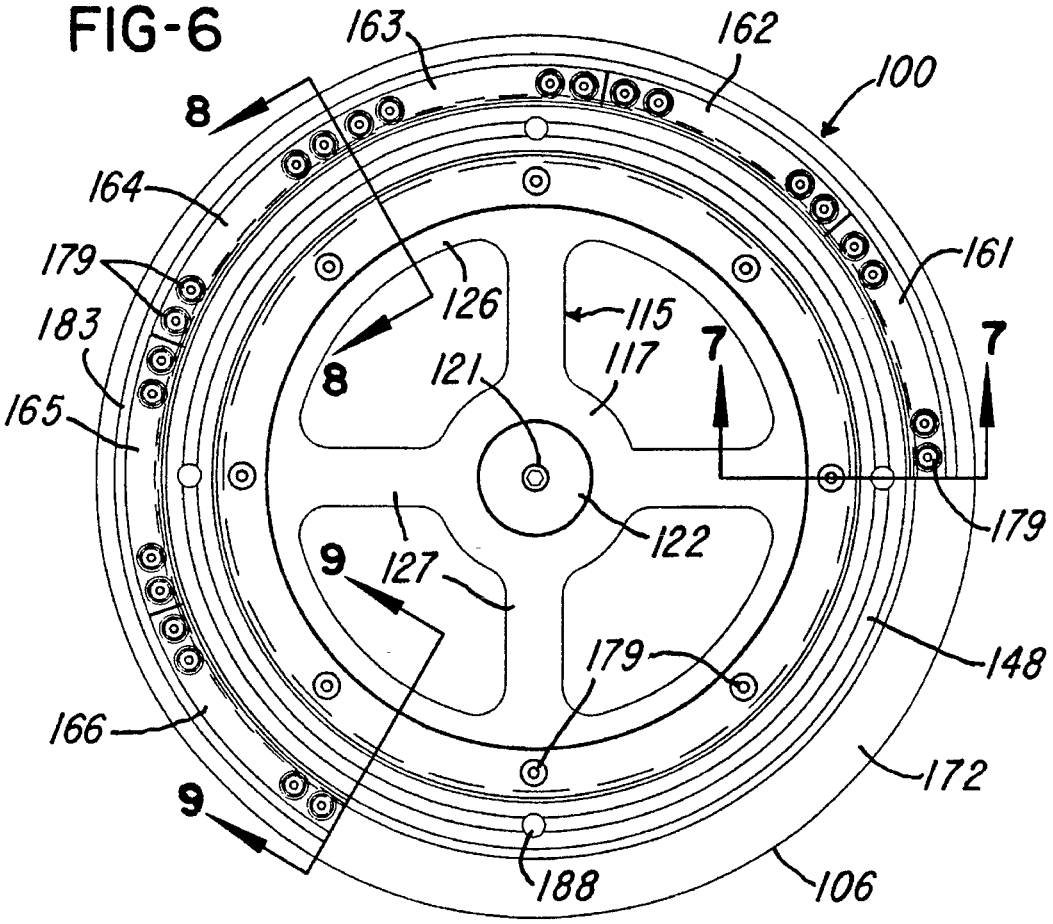
FIG. 6 is a plan view of the curling unit shown in FIG. 4.

Referring to FIGS. 4–6, since the curling units are identical in construction, only one will be described in detail. Each curling unit 100 includes a circular base 106 which is secured to the corresponding platform 102 by a set of screws 107. The base 106 includes a hub portion 109 which retains a pair of anti-friction bearings 111 for rotatably supporting a stepped shaft 114. A curling wheel 115 includes a hub portion 117 which is mounted on an upper end portion 119 of the shaft 114 and secured by a screw 121, a washer 122 and a key 123. The wheel 115 also includes a rim portion 126 which is integrally connected to the hub portion 117 by a set of four spoke members 127.

The shaft 114 also has a lower end portion 129 which is keyed and pinned to a bushing 132 extending through the hub portion of a drive pulley or sheave 134. The wheels 115 of each pair of curling units 100 supported by each platform 102 are driven by a single electric motor 138 (FIG. 1) supported by the platform 102. The motor has a depending shaft (not shown) on which is mounted double sheaves for driving the sheaves 134 of the curling units 100 through suitable V-belts.

Referring to FIGS. 4 & 5, the rim portion 126 of each curling wheel 115 has a slightly stepped cylindrical outer surface 142 which projects above a lower flange portion 144. A set of inner curling rings or die rings 146 seat within the surface 142 and are axially spaced by a corresponding set of shell support rings 148 which interfit between the inner die rings 146. A series of circumferentially spaced screws 151 extend through aligned holes within the rings 146 and 148 and are threaded into the lower flange portion 144 for securing the rings to the wheel 115. A set of shim or spacer washers 153 are interposed between the adjacent rings 146 and 148 and provide for precisely spacing the rings.

Each of the axially spaced inner curling or die rings 146 has a peripherally extending uniform groove 156 which is contoured to receive the crown portion 92 and lip portion 94 of the shells 55 which are fed successively to each support ring 148 of each curling unit 100. As shown in FIG. 1, the extension chutes 58 for two or three tooling modules 35 extend to each of the curling units 100 with two or three chutes 58 spaced vertically. The shells 55 flowing successively through the chutes 58 are fed into the curling unit at different levels so that the shells flowing within each chute 58 are received by the corresponding shell support ring 148.

Referring to FIGS. 5 & 6, the tooling for each curling unit 100 also includes a set of six arcuate outer curling ring segments 161–166 for opposing each of the inner curling rings 146 at each level. The ring segments 161–166 opposing the lowermost inner curling ring 146 are secured to an annular outer portion 172 of the base member 106 by a series of peripherally spaced screws 173 which extend through aligned holes within a spacer ring 176. Corresponding sets of screws 178 and 179 also extend through the upper sets of outer curling ring segments 161–166 and through holes within corresponding spacer rings 176 into threaded holes within the outer portion 172 of the base 106 for separately securing each set of ring segments 161–166 to the stationary base 106.

The base member 106 of each curling unit 100 also includes an upwardly projecting arcuate flange 183 (FIGS. 4 & 6) which extends 240° around the outer portion 172 of the base member 106. A series of peripherally spaced adjustment screws 186 project radially inwardly through the flange 183 and engage the set of arcuate curling ring segments 161–166 at each level for precisely positioning each set of ring segments in a radial direction before they are secured to the base member 106 by tightening the screws 173, 178 and 179. Lock nuts 187 secure the screws 186 after they are set. Each of the support rings 148 also has a series of circumferentially spaced holes 188 to provide access to shells supported by the support rings therebelow.

Referring to FIGS. 7–9, the arcuate ring segments 161–166 at each level have inner peripherally extending grooves 192–194 which gradually change in cross-sectional configuration For curling the lip portions 94 of the shells 55 inwardly. The shells are rolled between the inner and outer curling dies or rings or ring segments in response to rotation of the wheel 115 and while the shells are supported at the multiple levels by the shell support rings 148.

After the lip portions 94 of the shells 55 are curled inwardly by the curling units 100, the shells are successively discharged or propelled from the curling units and are directed through curved tubular guide chutes 202 (FIG. 1) and tubular extension chutes 203 and 204 to an air or vacuum driven down stacker unit 205. Each unit 205 collects the shells 55 from all three levels of each curling unit 100 and stacks the shells in a vertical stack.

From the drawings and the above description, it is apparent that apparatus constructed in accordance with the present invention for producing shells or similar articles provides desirable features and advantages. For example, the multi-level curling units 100 provide for curling a high volume of shells 55 and at a high speed with one curling level for each chute, and essentially eliminate the problem of down time due to jamming of the shells. The multi-level curling units also minimize the floor space required for curling shells and minimize the cost of constructing curling units for handling a large flow rate of shells. The arrangement of the tooling modules 35 and the discharge of the shells from both sides of the press 15 and into corresponding curling units 100, also provides for obtaining a high production rate of shells and for curling the lip portions 94 of the shells as fast as they are produced by the tooling or modules 35 within the press 15. As another advantage, the slightly differential elevation of the air jet nozzle outlets 67 provides for slightly staggering the discharge of shells 55 from the press 15 so that the shells flow successively through the curling units 100 and also flow from the curling units 100 into the down stackers 205 without overlapping or jamming. Thus the apparatus of the invention provides for significantly increasing the speed at which shells are produced and curled so that a higher production may be obtained from a single mechanical press. The press also provides for running a strip from a wide and more economical coil which does not require slitting.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for high speed production of metal shells each having a curled peripheral lip portion, said apparatus comprising a power operated reciprocating press including a plurality of shell forming stations extending in a row, each of said forming stations including tooling components for successively forming shells with strokes of the press, at least one curling unit including a base member supporting a shaft for rotation, a wheel positioned above said base member and having a hub portion connected to an outer rim portion, said hub portion mounted on said shaft for supporting said wheel for rotation on the axis of said shaft, a plurality of closely spaced inner die rings mounted in stacked relation on said rim portion of said wheel for rotation with said wheel, said base member including an outer portion extending around said rim portion of said wheel, a plurality of closely spaced outer forming dies mounted on said outer portion in stacked relation and radially opposing corresponding said inner die rings, said inner die rings and the corresponding opposing said outer forming dies forming a plurality of closely spaced lip curling stations each corresponding to one of said shell forming stations, each of said lip curling stations including a shell support member extending radially adjacent the corresponding said inner die ring and said outer forming die, a separate shell guide conveyor extending from each said shell forming station to the corresponding said lip curling station with a plurality of said guide conveyors connected to said lip curling stations in closely spaced relation, and means for propelling each shell formed at each said forming station along the corresponding said guide conveyor to the corresponding said lip curling station of said curling unit.

2. Apparatus as defined in claim 1 wherein each said shell support member includes a plurality of circumferentially spaced openings to provide access to the shells on the adjacent said support rings.

3. Apparatus as defined in claim 1 wherein said outer forming die of each said lip curling station comprises a series of circumferentially arranged arcuate outer die sections for each of said inner die rings, and means for releasably securing a plurality of said outer forming die sections in stacked relation to said annular portion of said base member.

4. Apparatus as defined in claim 1 wherein each of said shell guide conveyors comprises a substantially closed tubular chute for confining air, and said propelling means comprise a flow of air directed through each said chute from each said forming station to the corresponding said lip curling station.

5. Apparatus as defined in claim 1 wherein three of said inner die rings are mounted on said rim portion of each said wheel and cooperate with the corresponding said outer forming dies to form three of said lip curling stations.

6. Apparatus for high speed production of metal shells each having a curled peripheral lip portion, said apparatus comprising a power operated generally rectangular reciprocating press having opposite longitudinal sides and including a series of shell forming stations extending longitudinally in parallel spaced rows, each of said forming stations including tooling components for successively forming shells with strokes of said press, a plurality of curling units for each said side of said press, each of said curling units including a base member supporting a shaft for rotation, a wheel positioned above said base member of each said curling unit and having a hub portion connected to an outer rim portion, said hub portion mounted on said shaft for supporting said wheel for rotation on the axis of said shaft, a plurality of closely spaced inner die rings mounted in stacked relation on said rim portion of said wheel for rotation with said wheel, said base member including an outer portion extending around said rim portion of said wheel, a plurality of closely spaced outer forming dies mounted on said outer portion in stacked relation and radially opposing corresponding said inner die rings, said inner die rings and the corresponding opposing said outer forming dies forming a stack of closely spaced lip curling stations each corresponding to one of said shell forming stations, each of said lip curling stations including a shell support member extending radially adjacent the corresponding said inner die ring and said outer forming die, a separate shell guide conveyor extending from each said shell forming station to the corresponding said lip curling station with a plurality of said guide conveyors extending from each said side of said press and connected to said lip curling stations of one of said curling units in closely spaced relation, and means for propelling each shell formed at each said forming station along the corresponding said guide chute to the corresponding said lip curling station.

7. Apparatus as defined in claim 6 and including a plurality of air directing nozzles positioned between said first and second rows of said shell forming stations, and means for positioning said nozzles at slightly different elevations for said shell forming stations corresponding to each said curling unit for ejecting the shells from said press in staggered timed relation at the end of each stroke of said press.

8. Apparatus as defined in claim 6 wherein at least one of said curling units is located at each of the corners of said generally rectangular press.

9. Apparatus as defined in claim 6 wherein each of said shell guide conveyors comprises a substantially closed tubular chute for confining air, and said propelling means comprise a flow of air directed through each said chute from each said forming station to the corresponding said lip curling station.

10. Apparatus as defined in claim 6 wherein three of said inner die rings are mounted on said rim portion of each said wheel and cooperate with the corresponding said outer forming dies to form three of said lip curling stations.

11. Apparatus for high speed production of metal shells each having a curled peripheral lip portion, said apparatus comprising a curling unit including a base member supporting a shaft for rotation, a wheel positioned above said base member and having a hub portion connected to an outer rim portion, said hub portion mounted on said shaft for supporting said wheel for rotation on the axis of said shaft, a plurality of closely spaced inner die rings mounted in stacked relation on said rim portion of said wheel for rotation with said wheel, said base member including an outer portion extending around said rim portion of said wheel, a plurality of closely spaced outer Forming dies mounted on said outer portion in stacked relation and radially opposing corresponding said inner die rings, said inner die rings and the corresponding opposing said outer forming dies forming a stack of closely spaced lip curling stations for said wheel, and each of said lip curling stations including a shell support member extending radially adjacent the corresponding said inner die ring and said outer gorming die.

12. Apparatus as defined in claim 11 wherein said outer forming die of each said lip curling station comprises a series of circumferentially arranged arcuate outer die sections for each of said inner die rings, and means for releasably securing a plurality of said outer forming die sections in stacked relation to said annular portion of said base member.

13. Apparatus as defined in claim 11 wherein three of said inner die rings are mounted on said rim portion of each said wheel and cooperate with the corresponding said outer forming dies to form three of said lip curling stations for said wheel.

* * * * *

UNITED STATES PATENT AND TRADEMARK OFFICE

CERTIFICATE OF CORRECTION

PATENT NO. : 5,491,995
DATED : February 20, 1996
INVENTOR(S) : Ralph P. Stodd

It is certified that error appears in the above-indentified patent and that said Letters Patent is hereby corrected as shown below:

In the Abstract

Line 5, delete "s ides" and insert --sides--.

Column 2, line 28, delete "tile" and insert --the--.

Column 3, line 64, delete "For" and insert --for--.

Column 5, line 41, delete "For" and insert --for--.

Claim 11, column 8, line 26, delete "Forming" and insert --forming--.

Claim 11, column 8, line 34, delete "gorming" and insert --forming--.

Signed and Sealed this
Seventh Day of May, 1996

Bruce Lehman

*Attest:*

BRUCE LEHMAN

*Attesting Officer*

*Commissioner of Patents and Trademarks*